United States Patent [19]

Tamayo

[11] Patent Number: 4,960,346

[45] Date of Patent: Oct. 2, 1990

[54] CONTAINMENT UNIT WITH PLUG

[75] Inventor: Juan H. Tamayo, Miami, Fla.

[73] Assignee: Pemco, Inc., West Hollywood, Fla.

[21] Appl. No.: 262,444

[22] Filed: Oct. 25, 1988

[51] Int. Cl.[5] ..... B65G 5/00; B65B 3/06

[52] U.S. Cl. ..... 405/52; 141/86; 137/371; 405/128

[58] Field of Search ..... 405/52, 53, 128, 129; 141/86; 220/18

[56] References Cited

U.S. PATENT DOCUMENTS

| | | | |
|---|---|---|---|
| 4,278,115 | 7/1981 | Briles et al. | 141/86 |
| 4,491,147 | 1/1985 | Argandona | 137/371 |
| 4,520,852 | 6/1985 | Klein | 141/86 |
| 4,659,251 | 4/1987 | Petter et al. | 405/52 |
| 4,682,911 | 7/1987 | Moreland | 405/53 |
| 4,706,718 | 11/1987 | Milo | 141/86 |
| 4,762,440 | 8/1988 | Argandona | 405/52 |
| 4,770,317 | 9/1988 | Podgers et al. | 220/86 R |

*Primary Examiner*—Dennis L. Taylor

*Attorney, Agent, or Firm*—Malin, Haley, McHale, DiMaggio & Crosby

[57] ABSTRACT

The present invention pertains to a containment unit for use with a fill pipe of an underground storage tank. More specifically, the containment unit is constructed to collect any spilled fule in the filling process of the underground storage tank. The containment unit is provided with a floor having a coupling for connection to the fill pipe of the storage tank. The inner wall of the unit is of the bellows type to permit vertical expansion and retraction as required due to changing temperatures. Additionally, the floor of the containment unit is equipped with a removably inspection plug which permits ready access to the soil to take samples thereof thereby eliminating the need for disassembly of the containment unit to accomplish the testing.

11 Claims, 1 Drawing Sheet

CONTAINMENT UNIT WITH PLUG

BACKGROUND OF THE INVENTION

In recent years, there has become an increased awareness of our environment and the many destructive forces which are contributing to a rapid deterioriation of it.

As a result of this awareness, many states and also the Federal Government with its various environmental agencies have passed laws which have been designed to protect our environment against pollution. As we all know, there are many forms of pollution, for example, acid rain and its deleterious effects, flurocarbons and their effects on the ozone layers, chemical waste sites, nuclear waste dumping, and many more. Each of the above cited forms of pollution have all been dealt with by various governmental agencies, both state and federal, to control and reduce the amount of pollutants which are effecting the air we breathe, the water we drink, and also the intensity of the sun which shines upon us.

SUMMARY OF THE INVENTION

The subject invention is directed to a problem which directly effects our daily lives. Each day, millions of autos drive into their local gas station to refill the gas tanks of the millions of autos throughout our country. As we all have read at one time or another, the gas tanks which are located underground have developed leaks which, in some instances, have contaminated the local water supply or, in some cases, have seeped into the local sewerage systems.

Additionally, there have been some gas spills at local gas stations at the time of re-supply by the tanker truck which refills the station as his supply is used up. Frequently, the delivery man, after filling the respective tanks at a station, will cut-off the supply of gasoline to the underground tank, disconnect the hose from the tanker and incrementally raise the hose, which may be fifty feet in length and approximately five inches in diameter, and drain the gasoline contained therein, into the tank he has just filled. The problem arises when the tank is filled at the point of disconnection and the draining of the hose into the tank results in an overspill into the ground surrounding the fill pipe.

As is common in the industry, most fill pipes are provided with a containment chamber which will receive the excess gasoline as a result of emptying the hose. However, to insure that it is not common practice to overfill the containment chamber and let it evaporate, current regulations require that periodic inspections of the soil in the vicinity of the fill tube be made of various gas stations to determine if, in fact, such spillage has occurred.

Presently, in the industry, all containment devices are totally enclosed, i.e., no means are provided to permit a soil sampling to determine if spillage or tank leakage has occurred. Present containment devices require that the unit be disassembled to permit access to the soil in the vicinity of the fill pipe to take the required samplings and then reassembled to restore the containment device to its original condition.

As can readily be seen, such a procedure is a time consuming operation as well as labor extensive. It was with this knowledge in mind that applicant was motivated to develop a containment unit which permits ready access to perform the necessary samplings and tests required by the various governmental agencies.

OBJECTS OF THE INVENTION

An object of the invention is to provide a containment unit which permits ready access to soil in the vicinity thereof.

A further object of the invention is to provide an access aperture which is totally sealed when securely mounted therein.

Yet another object of the invention is to provide a containment device which permits ready access to comply with various environmental regulations.

A further of the invention is to provide a containment device which is inexpensive to install.

A still further object of the invention is the provision of a containment device which is readily adapted to a standard fill pipe.

These and other objects of the instant invention will become more apparent hereinafter. The instant invention will now be described with particular reference to the accompanying drawings which form a part of this specification wherein like reference characters designate the corresponding parts in the several views.

DETAILED DESCRIPTION OF THE DRAWINGS

Figure 1:
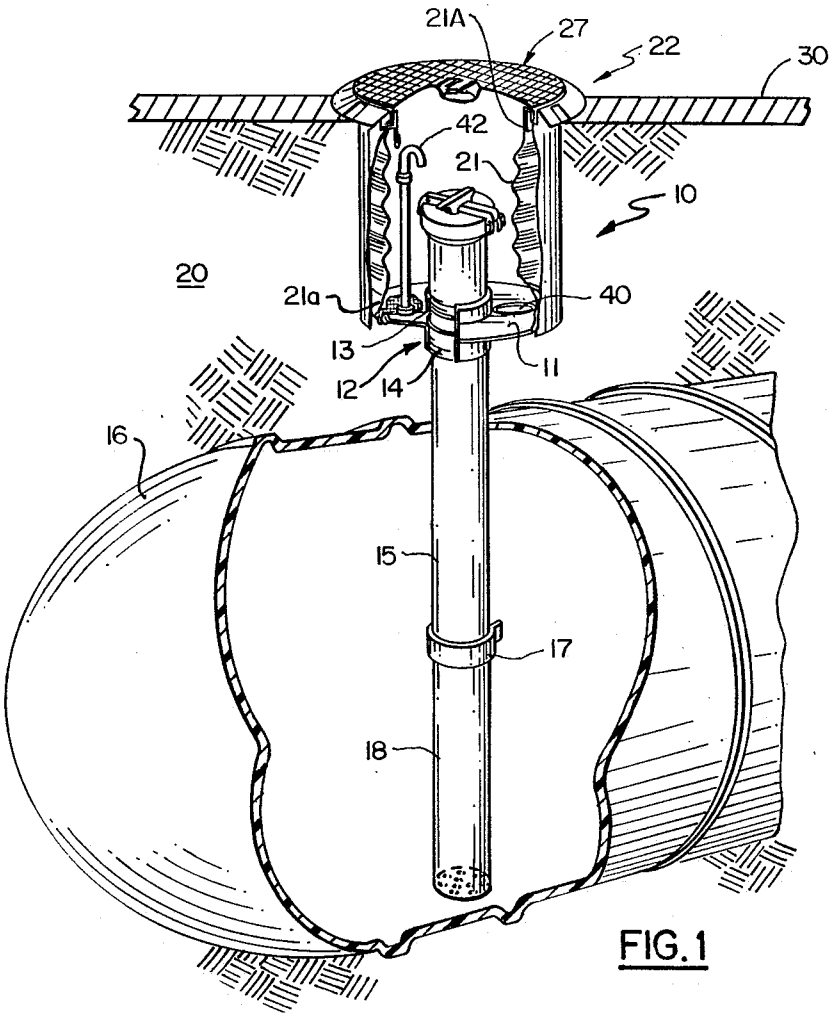
FIG. 1 is a cut-away view showing the novel containment device in relation to an underground tank and its fill pipe.

Referring now to FIG. 1, there is an illustration of the novel containment unit 10 with its uppermost portion set above the asphalt 30 to ensure that rain water, melting snow or ice will drain away from the unit 10. As illustrated, the internal floor 11 is provided with a centrally located coupling member 12 having an upper and lower threaded portion 13 and 14, respectively. Lower threaded portion 14 is connected to fill pipe 15 which enters storage tank 16 and extends downwardly to a point near the bottom thereof. Storage tank 16 is a conventional storage tank made of fiberglass reinforced material. There is also shown in FIG. 1, a coupling member 17 which connects the upper portion of fill pipe 15 with a lower portion 18. As shown in FIG. 1, the storage tank 16 is located a substantial distance below the asphalt 30 and is compacted with earth 20 therearound. The purpose of so locating the storage tank 16 is to ensure that heavy vehicles on the asphalt 30 will not have a damaging effect on the fiberglass storage tank 16 should it be in an empty condition.

Figure 2:
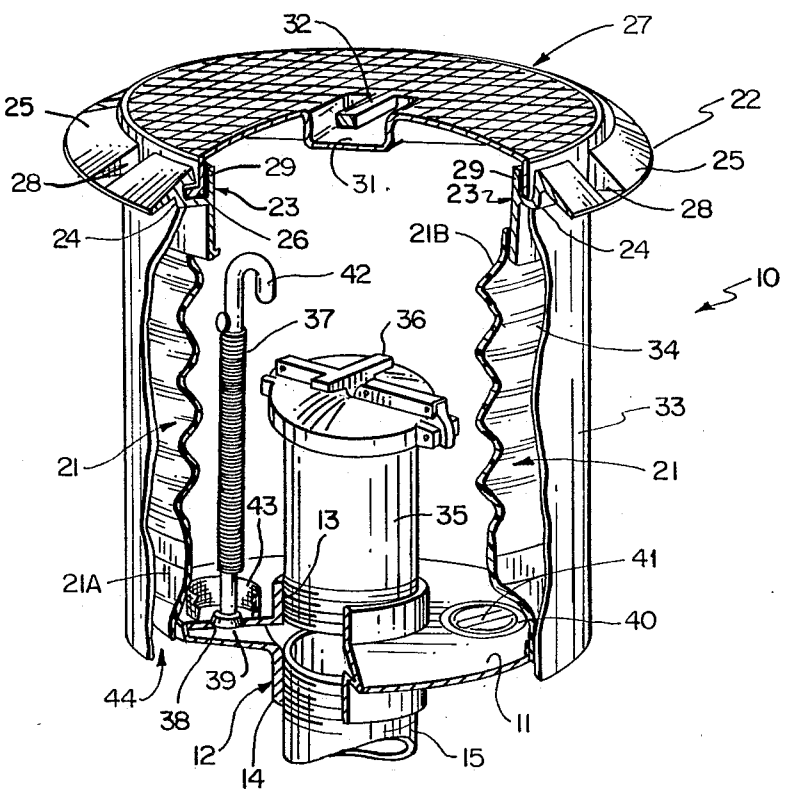
FIG. 2 is an enlarged view of the novel containment device with plug to permit soil sampling thereabout.

Referring now to FIG. 2, there is shown an enlarged cut-away view of the novel containment unit 10. As indicated above unit 10 is provided with an internal floor or base 11, the outer periphery of which is connected to a bellows type vertically extending circumferential wall 21 at lowermost circumferential end 21A. The connection between the periphery of internal floor 11 and circumferential wall 21 is a leakproof joint to insure that any spilled gasoline in the filling process will not contaminate the adjacent soil 20. The uppermost circumferential edge 21B of wall 21 is attached to annular rim 22 which is provided with an upwardly opening U-shaped channel 23. The outer leg 24 of U-shaped channel 23 is provided with a tapered rim 25 sloping away from the vertical axis of unit 10. U-shaped channel 23 receives lugs 26 of cover 27. Tapered rim 22 is provided with a plurality of circumferentially spaced cut-out areas 28 which receive spaced lugs 26 which project radially outwardly from skirt portion 29 of cover 27. The central portion of cover 27 is provided with a recessed area 31 and a handle portion 32 to permit the cover 27 to be grasped with one hand. In removing cover 27, one merely grasps handle 32 and rotates cover 27 in either direction until lugs 26 align with cut-out portions 28 in rim 22, then the cover 27 may be lifted and removed from containment unit 10 providing access to the inside thereof.

Attached to the bottom of outer leg 24 of U-shaped channel 23 is outer wall 33 which depends therefrom and extends downwardly to a point slightly below internal floor 11. It is to be noted that outer wall 33 is concentric with bellows wall 21 with an annular gap 34 therebetween. It is also noted that at the lowermost end of outer wall 33 the annular gap 34 is open as illustrated by reference numeral 44.

As indicated above, internal floor 11 is provided with an upper threaded portion 13 which threadedly receives nipple 35. Nipple 35 is provided with threads at its upper end for receiving fill cap 36. Fill cap 36 is a conventional cap which receives a padlock (not shown) to prevent unauthorized entry whether it be theft or vandalism. Bellows wall 21 permits expansion or contraction of the pipe 15 due to changing weather conditions and varying temperatures.

Internal floor 11 is provided with a removable inspection plug 40 which is threaded therein. Inspection plug 40 is provided with a central recess 41 to receive an appropriate tool for removing inspection plug 40. The purpose of inspection plug 40 is to permit access to the soil beneath containment unit 10. As pointed earlier, state and/or Federal regulations require inspections to be made to determine whether or not spillage and contamination due to leakage has occurred.

In instances where a conventional containment unit has been used, i.e. one without an inspection plug, the entire containment unit must be disconnected from fill pipe 15 to permit access to the soil therebeneath. As can readily be seen, such a procedure can prove to be a costly endeavor requiring the use of a back-hoe or extensive manual labor to permit the required access. Removing the containment unit usually requires shutting down the service station for an extended period of time until the inspection has been completed, thus adding to the overall expense.

Also shown in FIG. 2, within containment unit 10 is a spring biased valve 37 which is provided with a seat 38 to close opening 39. As can be seen opening 39 leads to the gap between upper and lower threaded portions 13 and 14 and permits draining of any fuel in the bottom of containment unit 10 into fill pipe 15. The uppermost end of valve 37 terminates in an inverted J 42. A filtering screen 43 surrounds opening 39 to prevent any debris from falling into fill pipe 15.

While this invention has been described in its preferred embodiment, it is to be understood that the words which have been used are words of description rather than limitation and that changes may be made within the purview of the appended claims without departing from the full scope or spirit of the invention.

Having thus described my invention:

1. A containment unit for use with the fill pipe of an underground fuel storage tank wherein said containment unit comprises:

base means including central coupling means for connection to said fill pipe; an upwardly extending nipple projecting from said coupling means; flexible wall means having an upper and lower end with said lower end attached to the periphery of said base means; said upper end of said flexible wall means fixedly attached to annular rim means; outer wall means securely attached to said annular rim means radially outward of the connection of the upper end of said flexible wall means to said annular rim means; flow control means operably connected to the uppermost end of said nipple; cover means removably recieved in said annular rim means and a removable inspection plug sealingly disposed through said base means, said removable inspection plug permitting access to the soil beneath said containment unit in the vicinity of said underground fuel storage tank to determine if leaks and soil contamination has occurred.

2. A containment unit of the character described in claim 1 wherein said base means comprises an annular disk with said coupling means including an upper and lower coupling for connection with said nipple and said fill pipe, respectively.

3. A containment unit of the character described in claim 1 wherein said flexible wall means is in the form of a plurality bellows which permits movement and expansion or contraction of the containment unit.

4. A containment unit of the character defined in claim 1 wherein said outer wall means comprises a rigid annular wall which extends downwardly below the level of said base means.

5. A containment of the character defined in claim 4 wherein the positioning of said outer wall relative to said flexible wall means provides an annular gap therebetween which is open at the lowermost end thereof.

6. A containment unit of the character described in claim 1 wherein said annular rim means comprises an inner U-shaped channel with a tapered portion extending radially therefrom, said tapered portion having a plurality of circumferentially spaced recess means.

7. A containment unit of the character described in claim 6 wherein said recess means permits access to said U-shaped channel.

8. A containment unit of the character defined in claim 1 wherein said flow control means comprises a lockable cap attached to the uppermost end of said nipple to prevent unauthorized access to said fill pipe.

9. A containment unit of the character described in claim 1 wherein said cover means comprises a planar portion having a downwardly extending flange with a plurality of circumferentially spaced locking lugs, said locking lugs, when received in said recess means and rotated into said U-shaped channel means under said tapered rim serve to lock said cover with respect to said containment unit.

10. A containment unit of the character described in claim 1 wherein said removable inspection plug is threadably disposed through an aperture in said base means thereby permitting insertion of a sampling device into the soil beneath said unit to determine if leakage and contamination has occurred.

11. A containment unit of the character described in claim 1 wherein said removable inspection plug further includes a tool receiving recess whereby a tool may be inserted into said tool receiving recess to permit removal of said plug.

* * * * *